United States Patent [19]

Färber

[11] Patent Number: 4,666,044

[45] Date of Patent: May 19, 1987

[54] TEAR-OPEN FLAP ORIFICE ON PACKS CONSISTING OF PLASTIC-COATED LAMINATED MATERIAL WITH A FOLDED-ROUND FILLET-SEAM CLOSURE AND A PROCESS FOR PRODUCING THE TEAR-OPEN FLAP ORIFICE

[75] Inventor: Jürgen Färber, Kaarst, Fed. Rep. of Germany

[73] Assignee: PKL Verpackungssysteme GmbH, Dusseldorf, Fed. Rep. of Germany

[21] Appl. No.: 786,902

[22] Filed: Oct. 11, 1985

[30] Foreign Application Priority Data

Oct. 25, 1984 [DE] Fed. Rep. of Germany ..... 3439102

[51] Int. Cl.[4] ..... B65D 5/72

[52] U.S. Cl. ..... 206/606; 206/620; 206/627; 206/633; 229/17 G; 493/340

[58] Field of Search ..... 206/484, 601, 611, 613, 206/620, 631–634, 606; 229/17 R, 17 G; 493/340

[56] References Cited

U.S. PATENT DOCUMENTS

| | | | |
|---|---|---|---|
| 3,085,733 | 4/1963 | Umanoff | 229/17 R |
| 3,563,447 | 10/1968 | Katzenmeyer | 229/17 R |
| 3,604,613 | 9/1971 | Haas | 229/17 G |
| 3,773,248 | 11/1973 | Cecil et al. | 206/613 |
| 3,869,078 | 3/1975 | Braun | 229/17 R |
| 4,126,263 | 11/1978 | Martensson | 229/17 R |
| 4,244,474 | 1/1981 | Wise . | |
| 4,245,743 | 1/1981 | Heuberger | 206/611 |
| 4,327,833 | 5/1982 | Kuchenbecker | 229/17 R |
| 4,512,478 | 4/1985 | Korte | 206/611 |

FOREIGN PATENT DOCUMENTS

| | | | |
|---|---|---|---|
| 678370 | 1/1964 | Canada . | |
| 0098049 | 2/1964 | Denmark | 206/611 |
| 039116 | 11/1981 | European Pat. Off. . | |
| 0941655 | 11/1963 | United Kingdom | 206/611 |

*Primary Examiner*—William Price
*Assistant Examiner*—Jimmy G. Foster
*Attorney, Agent, or Firm*—Sprung Horn Kramer & Woods

[57] ABSTRACT

The invention relates to a tear-open flap orifice on packs consisting of plastic-coated laminated material with a folded-round fillet-seam closure (10), there being in a first seam region (14) at least one full cut and in a second seam region (15) at least one weakening line in the form of a half cut which extends beyond the second seam region into the region of the first pack surface in contact with the filling material of the pack. As a result of an appropriate arrangement of the full cuts and half cuts, an easy-to-handle tear-open flap orifice is obtained by simple means for the entire range from drinking-straw, pour-out, drinking and spoon orifices to separating-strip orifices on freeze packs.

12 Claims, 15 Drawing Figures

Figure 1:
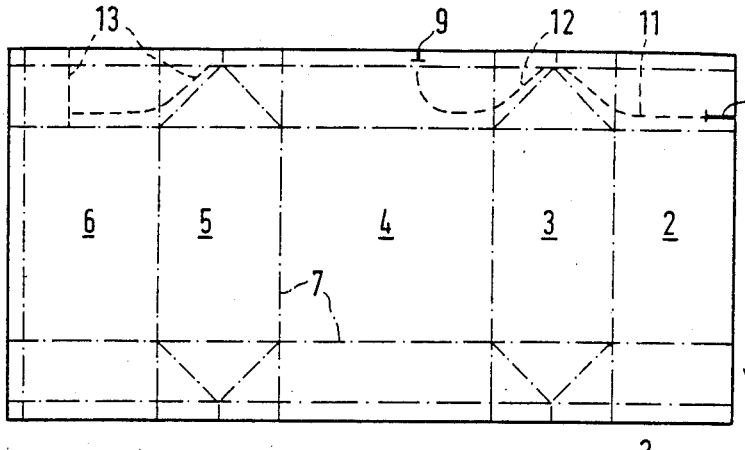

TEAR-OPEN FLAP ORIFICE ON PACKS CONSISTING OF PLASTIC-COATED LAMINATED MATERIAL WITH A FOLDED-ROUND FILLET-SEAM CLOSURE AND A PROCESS FOR PRODUCING THE TEAR-OPEN FLAP ORIFICE

The invention relates to a tear-open flap orifice on packs consisting of plastic-coated laminated material with a folded-round fillet-seam closure.

Many versions of tear-open flap orifices on packs have become known. For example, it is known to stamp or punch out in the orifice regio of a pack portions which are then substantially reclosed by means of tear-open flaps. However, a disadvantage of these flaps which are not in one piece with the pack is that, as regards sensitive products for which not only dust-proof, but also liquid-tight or even gas-tight packaging is required, but especially where aseptic packs are concerned, the inner coating of the laminated material, originally extending over the entire surface of the latter, is perforated in the region of the orifice, and under certain circumstances this can result in a reduction in the quality of the filling material. Furthermore, these tear-open flaps and the application process necessary for fastening them to the pack involve a high outlay.

Tear-open flaps made in one piece with the pack have therefore also already been developed. Thus, for example European Patent Application No. 39,116 illustrates and describes a liquid pack with a tear-open flap orifice, into which a straw can be introduced. The drinking-straw hole is integrated into the side seam of the pack and limited by incisions and cut-outs in the latter. If desired, a further incision can be provided in the covered seam part, in order during the tearing-open action to loosen the covering layer from the laminated material and prevent incorrect opening. The tear-open flaps produced in this way are very short and are easier to handle only when expensive shaping cuts are made. Moreover, the tear-open flap orifice is located in the region of an overlapping seam and can therefore only be used for product requiring no all-round edge protection. It is consequently unsuitable for aseptic packs.

U.S. Pat. No. 4,244,474 makes known a further tear-open flap orifice, in which a tear-open flap can be formed by means of parallel incisions in the carrier material of the laminated material. This tear-open flap finally merges into a circular orifice, but this and the surface located between the cuts are still covered by the layers of laminated material which have not been severed. Consequently, this orifice can be used only when this existing layer is pierced by a straw, and is therefore also designed for this purpose only.

Finally, Canadian Patent Specification 678,370 makes known a pack with a tear-open flap orifice, in which continuous cuts and adjoining perforations are provided in the region of an overlapping seam, so that the pack can be torn open laterally to obtain an orifice. At the same time, as a result of further approximately V-shaped incisions in the other pack surface, when the pack is torn open the orifice is also opened via the tear-open flap. Apart from the fact that a closing device of this type is again unsuitable for aseptic packs with all-round edge protection provided by a folded-round fillet seam, in addition, here again, an expensive shaping cut is necessary to make the appropriate incisions in the region of the overlapping seam.

The object on which the invention is based is, therefore, to provide a tear-open flap orifice on packs consisting of plastic-coated laminated material with a folded-round fillet-seam closure, which is simple and economical to produce without the use of expensive shaping cuts and which is easy and convenient to handle, while at the same time avoiding uncontrolled damage to the folded-round fillet-seam closure.

According to the invention, this object is achieved because the folded-round fillet-seam closure has, in a first seam region extending from a longitudinal margin edge of a first pack surface approximately up to the folded-round edge of a second pack surface connected to the first pack surface via the fillet-seam closure, at least one full cut formed as a result of an incision in the first pack surface and, in a second seam region adjoining the first seam region, as an extension of the full cut at least one weakening line which extends beyond the second seam region into the region of the first pack surface in contact with the filling material of the pack. The means according to the invention provide a tear-open flap orifice which, while being simple to produce, can be handled reliably. They also ensure that no damage or weakening of the inner coating in contact with the filling material of the pack occurs.

In an appropriate embodiment, the weakening line or the weakening lines is or are formed by a half cut which only partially severs the single-layer or multilayer wall of the first pack surface. It goes without saying that a perforation can also be used instead of a half cut. In order, on the one hand, to improve the handling of the tear-open flap orifice and, on the other hand, to guarantee the necessary leak-proofing of the pack, according to a further feature of the invention the first seam region having the full cut or full cuts is made wider than the second seam region having the half cut or half cuts.

Then, when, according to a further feature of the invention, in the top side of the second pack surface facing the first pack surface, a weakening line (half cut) extending at a short distance, for example 0–3 mm, from and parallel to the longitudinal margin edge of the first pack surface is arranged in a region of the fillet-seam closure limited by the full cut or full cuts and forming a tear-off tab, the pack can be opened even more easily, since the tear-off tab can be grasped very easily and the complete orifice made by means of this and by means of the weakening lines adjoining it.

Instead of the weakening line extending parallel to the margin edge, in the region of the fillet-seam closure limited by the full cut or full cuts or the half cut or half cuts, an anti-adhesive agent can be coated on between the top side of the second pack surface and the adjacent underside of the first pack surface as well as the underside of the folded-round edge. In this case also, the tear-off flap orifice can easily be opened via the tear-off tab and as a result of the subsequent bursting apart of the edge protection and the inner coating, so that the space containing the filling material is readily accessible.

The opening tab limited by a single full cut can be arranged in a corner region of the fillet-seam closure or else in the central region of the latter. In this case, the region limiting the opening tab is formed by two full cuts extending at a distance from one another. Weakening lines can then adjoin the full cut or full cuts as desired, for example in such a way that a separating strip running all round the pack is formed between the weakening lines, or in such a way that the two full cuts are connected to one another by means of a common half cut.

If the weakening lines run outwards in an appropriate way, starting from the full cut or full cuts, spoon orifices can also be formed thus in the pack, in addition to a drinking-straw, pour-out and drinking orifice. It is expedient, at the same time, if the weakening lines taper to a point behind the full cuts and if the orifice tip extends into the region of lug-like folding triangles resting against the sides of the pack. Packs of this type can be opened easily and no filling material is spilt during oepning, since the pack, when opened, stands completely on a base by means of the pack bottom, at the same time preserving the folding geometry, that is to say there is no deformation of the space containing the filling material. Only the corner seam has to be raised on so-called lug-type packs.

A process suitable for forming a tear-open flap orifice on packs is of particular importance for the present invention, and in this process the full cut or full cuts and the weakening line or weakening lines (half cuts) are made in the pack surfaces in one operation together with the printing, grooving and stamping of the ready-coated laminated material.

In this way, the tear-open flap orifice or the full cut and half cut necessary for it can be made very easily by sheet cutting on a press stamp, and to produce the blank there is no need for any complicated shaping cuts, but this can be carried out by means of reel cutters, longitudinal cutters and cross-cutters.

Figure 2:
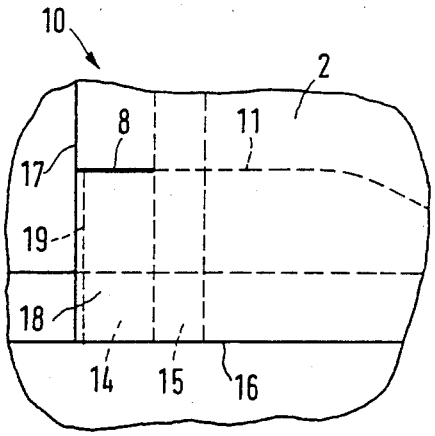
Figure 3:
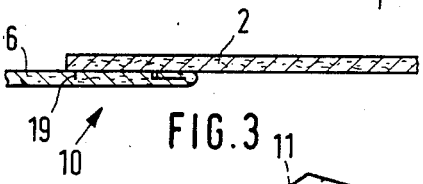
Figure 4:
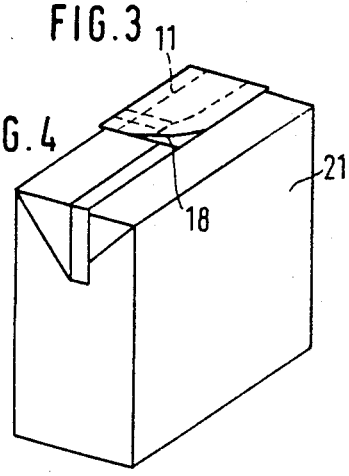
Figure 5:
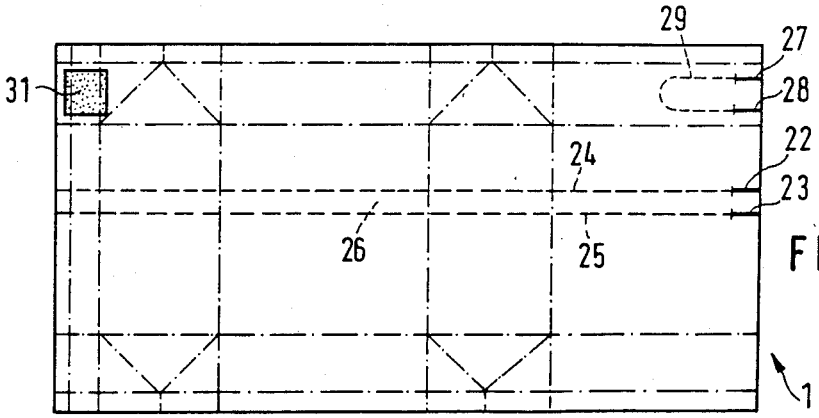
Figure 6:
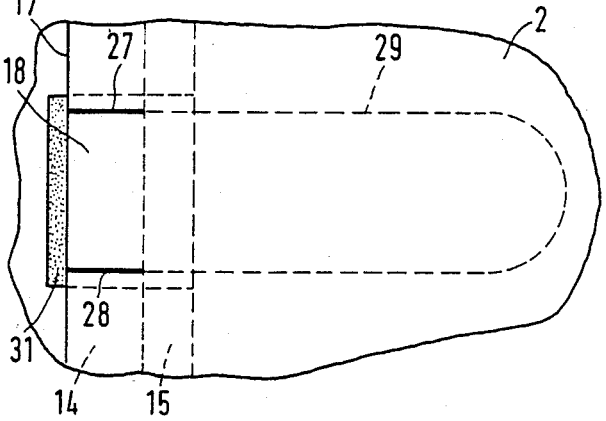
Figure 7:
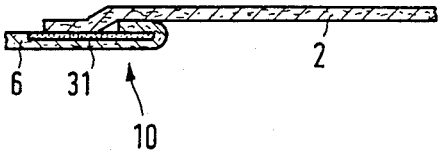
Figure 10:
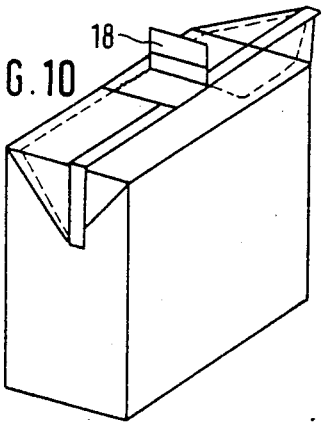
Figure 8:
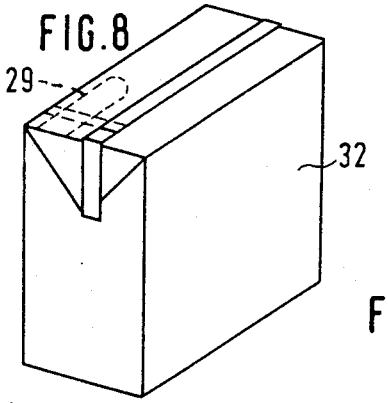
Figure 11:
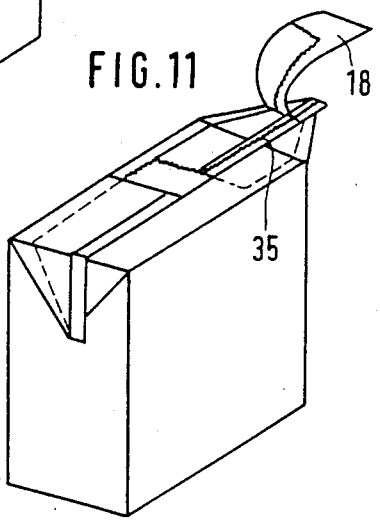
Figure 12:
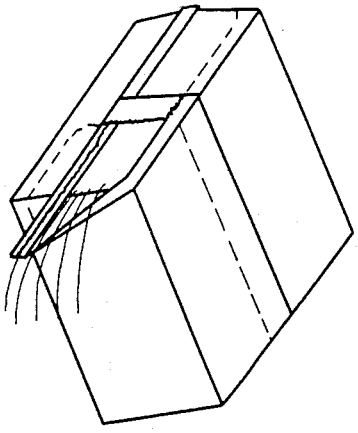
Figure 13:
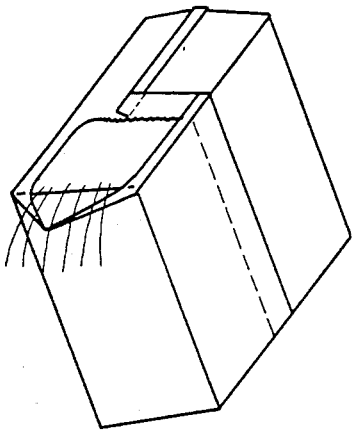
Figure 14:
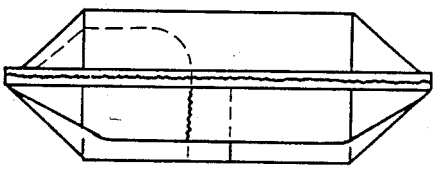
Figure 15:
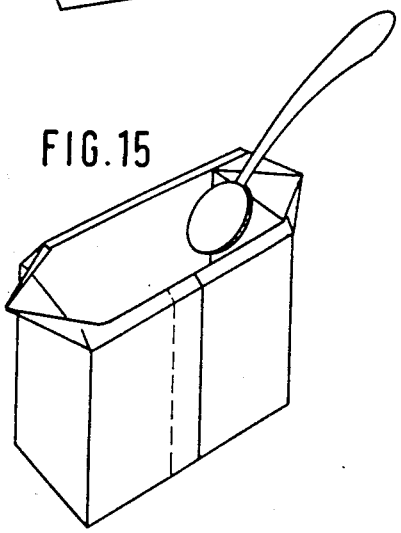

Preferred exemplary embodiments of the invention are illustrated in the drawing and described in more detail below. In the drawing:

FIG. 1 shows a plan view of a pack blank with full cuts and half cuts for forming a tear-open flap orifice in the corner region of a folded-round fillet-seam closure, FIG. 2 shows a partial cut-out from the arrangement illustrated in FIG. 1, FIG. 3 shows a cross-section through the partial cutout illustrated in FIG. 2, with a peeled-back fillet-seam, FIG. 4 shows a pack with a tear-open flap orifice according to FIGS. 1 to 3, FIG. 5 shows a plan view of a pack blank with full cuts and half cuts for forming a tear-open flap orifice in the central region of the fillet-seam closure, FIG. 6 shows a partial cut-out from the arrangement, shown in FIG. 5, of a tear-open flap orifice in the central region of the fillet-seam closure, FIG. 7 shows a cross-section through the fillet-seam closure shown in FIG. 6, with an anti-adhesive agent, FIG. 8 shows a pack with a tear-open flap orifice according to FIGS. 5 to 7, FIGS. 9–11 show a pack in various stages of opening, FIG. 12 shows a pack with a pour-out orifice, FIG. 13 shows a pack with a drinking orifice, and FIGS. 14 and 15 shows respectively a plan view and a diagrammatic representation of a pack with a spoon orifice.

FIG. 1 illustrates a blank of laminated material for producing a pack. The laminated material consists, in a known way, of an outer plastic coating, a carrier material composed of carboard or the like, a lining film, an aluminium layer and an inner plastic coating. The blank 1 has pack surfaces, 2, 3, 4, 5 and 6, and in the rest of the description the pack surface 2 is designated the first pack surface and the pack surface 6 the second pack surface. After the blank 1 has been folded along grooved lines 7 provided in it, the first pack surface 2 and second pack surface 6 can be connected to one another by means of a folded-round fillet-seam, as illustrated in FIG. 3. This is a peeled-back fillet-seam, that is to say the free end of the second pack surface 6 is folded round inwards, so that an edge protection is obtained all round along the seam. An incision in the form of a full cut 8 and a further full cut 9 and weakening lines adjoining each of them and in the form of half cuts 11,12 are made in the pack surface 2. A further weakening line 13 can be provided in the pack surfaces 5 and 6, its purpose being explained in more detail below.

As emerges from FIG. 2, the full cut 8 extends over a first seam region 14 of the fillet-seam closure 10, the first seam region 14 being wider than the second seam region 15, over which the half cut 1 extends and which finally extends further over the pack surfaces 2 and 3. The full cut 8 runs parallel to a margin edge 16 and transversely relative to a further margin edge 17 fillet-seam closure 10 a tear-off tab 18, under which a further weakening line in the form of a half cut 19 extends, specifically at a short distance of up to approximately 3 mm from the margin edge 17, to make it easier to tear the material out of the pack surface 6 parallel to the margin edge 17. A pack 21 provided with a tear-open flap orifice of this type is illustrated in FIG. 4. It can be seen here that an orifice can be obtained via the tear-open tab 18 and when the material of the pack surface 6 is torn with it and further torn along the half cut 11, as explained in more detail below.

The exemplary embodiment illustrated in FIGS. 5 to 8 starts from a blank 1, in which, in a central region of the folded-round fillet-seam formed, two full cuts 22, 23 are made, to which half cuts 24, 25 are joined to form a separating strip 26 extending all around the pack to be formed and suitable, for example, for freeze packs.

A further modified illustration is also shown in FIG. 5, in which two full cuts 27, 28 are arranged at a distance from and parallel to one another and are connected to one another by means of a common half cut 29. This arrangement is shown in more detail in FIG. 6. Here again, the full cuts 27, 28 extend over the first seam region 14 and the weakening line 29 extends over the second seam region 15 and the pack surface 2 in contact with the filling material. In this case, an anti-adhesive agent 31 is coated on between the top side of the second pack surface 6 and the facing underside of the pack surface 2 as well as the folded-round edge of the fillet-seam closure, and the surface of this anti-adhesive agent 31 is slightly greater than the region limited by the full cuts 27, 28 and the margin edge 17.

A pack 32 provided with a tear-open flap orifice of this type is illustrated in FIG. 8. An orifice of this type is suitable, for example, for pourable powdery materials.

A full cut is a cut which severs the entire laminated structure, while a half cut only severs the outer plastic coating and the carrier material, but leaves the other layers intact.

Figure 9:
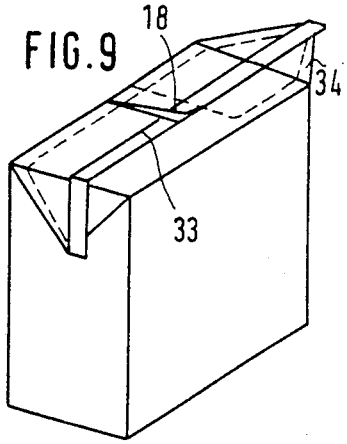

FIGS. 9 to 11 each show the sequence according to which the pack orifice is produced. Here, when the tear-open flap orifice is arranged in the region of a pack-top fillet-seam 33, a pack lug formed by a folding triangle 34 is first swung into a horizontal position. The tear-off tab 18 is then grasped and swung upwards. The layer of the second pack surface 6 located underneath is then also torn off in a precisely controlled way as a result of the bursting apart of the edge protection (FIG. 10) and the orifice produced subsequently as a result of further tearing along the weakening lines, are illustrated in FIG. 11. As indicated in the Figures mentioned, further weakening lines can be provided to obtain differing orifices, for example a pour-out orifice according to FIG. 12, a drinking orifice according to FIG. 13 and a spoon orifice according to FIGS. 14 and 15.

A weakening line can also be formed directly by means of the sealing-seam edge of pack-top fillet-seam 33, as indicated in FIG. 11. If a larger orifice is to be obtained, the weakening lines must widen outwards, starting from the full cuts, then finally converging again to a point at the front. It is important, here, that the orifice tip should extend into the region of the lug-like folding triangles 34, since only in this way is it possible to pour out safely a product contained in the pack.

The full cuts and half cuts are appropriately made in one operation together with the printing, grooving and stamping of the ready-coated laminated material by means of sheet cutting carried out by a press stamp.

It goes without saying that the weakening line 29 extending parallel to the margin edge 17 can also be made further inwards and also in conjunction with the anti-adhesive agent, so that the laminated structure to be severed is brought to half thickness when the fillet seam is not peeled back, thus making the tearing-open operation easier.

It is understood that the specification and examples are illustrative but not limitative of the present invention and that other embodiments within the spirit and scope of the invention will suggest themselves to those skilled in the art.

I claim:

1. In a container for liquid having a rip-out tab opening, the container having a ridged-seam closure wherein a first pack surface sheet is connected overlapping to a second pack surface sheet, said second pack surface sheet being interior of said first pack surface sheet and having an edge at said overlapping connection that is folded back such that the second pack surface sheet is folded against itself the ridged-seam closure defining a first seam area that extends from the bordering edge of the first pack surface sheet to the folded-back edge of the second pack surface sheet and defining a second, contiguous, seam area that extends from the folded-back edge of the second pack surface sheet to the fold, the first seam area, the improvement which comprises providing an opening incision in the form of at least one completely penetrating incision (8, 22, 23, 27, & 28) in the first pack surface sheet (2) in the first seam area (14) and at least one halfway-penetrating incision (11, 12, 24, 25, & 29) in the second seam area (15) extending out from the completely penetrating incision and continuing beyond the second seam area (15) into the area of the first pack surface sheet (2) that comes into contact with the contents of the container (21 & 32).

2. A container according to claim 1 characterised in that, in a top side of the second pack surface sheet (6) facing the first pack surface sheet (2), a weakening line (half cut) (19) extends at a short distance from and parallel to a longitudinal margin edge (17) of the first pack surface sheet and (2) is arranged in a region of the closure (10) which is limited by the completely penetrating incision (8) and which constitutes a tear-off tab (18).

3. A container according to claim 1 characterised in that, in regions of the closure (10) which are limited by the opening incision an anti-adhesive agent (31) being coated on between a top side of the second pack surface sheet (6) and an underside of the first pack surface sheet (2) as well as an underside of the folded-round edge of the closure.

4. A container orifice according to claim 3 characterised in that the coating-on surface of the anti-adhesive agent (31) is slightly larger than the region of the closure (10) limited by the opening incision and by a longitudinal margin edge (17) of the first pack surface sheet (2).

5. A container according to claim 1 characterised in that an opening tab (18) limited by the completely penetrating incision (8) is arranged in a corner region of the closure (10).

6. A container according to claim 1 characterised in that an opening tab (18) limited by completely penetrating incisions (22, 23, 27, 28) extending at a distance from one another is arranged in a central region of the closure.

7. A container orifice according to claim 6 characterised in that separate halfway penetrating incisions (24, 25) containing between them a separating strip (26) extending round the container are aligned respectively to the two completely penetrating incisions (22, 23).

8. A container orifice according to claim 6, characterised in that a halfway-penetrating incision (29) connects the two completely penetrating incisions (27, 28) to one another.

9. A container according to claim 1, characterised in that a halfway-penetrating incision (11) tapering to a point is aligned to the completely penetrating incision (8) arranged in a corner region of the closure (10), as an extension of the completely penetrating incision (8), and in that a further weakening line is formed by a sealing-seam edge (35) of a pack-top fillet seam (33) extending essentially transversely relative to the closure (10).

10. A container orifice according to claim 9, characterised in that, starting from completely penetrating incisions (8, 9), weakening lines (11, 12, 13), extends and widens an orifice to be formed, first extending outwardly and then tapering to a point, and in that an orifice tip extends into a region of lug-like folding triangles (34) resting against sides of the container (21, 32).

11. A process of making the container as set forth in claim 6, characterised in that the the opening incision are made in the pack surface sheets in one operation together with printing, grooving and stamping of ready-coated laminated material.

12. A container according to claim 1, filled with liquid.

* * * * *

UNITED STATES PATENT AND TRADEMARK OFFICE

CERTIFICATE OF CORRECTION

PATENT NO. : 4,666,044

DATED : May 19, 1987

INVENTOR(S) : Jürgen Färber

It is certified that error appears in the above-identified patent and that said Letters Patent is hereby corrected as shown below:

| | |
|---|---|
| Title Page, Abstract | After last line insert --Figure 1 is intended for the abstract.-- |
| Col. 1, line 12 | Delete "regio" and substitute --region-- |
| Col. 1, line 13 | Delete "substantially" and substitute --subsequently-- |
| Col. 1, line 43 | After "product" insert --groups-- |
| Col. 3, line 12 | Correct spelling of --opening-- |
| Col. 3, line 57 | Delete "shows" and substitute --show-- |
| Col. 4, line 19 | After "edge 17" insert --of the pack surface 2. The full cut 8 forms in the-- |
| Col. 4, line 68 | Delete "orifice" and substitute --orifices-- |
| Col. 5, line 46 | After "seam area" insert --being wider than the second seam area-- |
| Col. 6, line 29 | Between "halfway" and "penetrating" insert -- - -- |

UNITED STATES PATENT AND TRADEMARK OFFICE

CERTIFICATE OF CORRECTION

PATENT NO. : 4,666,044

DATED : May 19, 1987

INVENTOR(S) : Jürgen Färber

It is certified that error appears in the above-identified patent and that said Letters Patent is hereby corrected as shown below:

| | |
|---|---|
| Col. 6, line 53 | Delete "claim 6" and substitute --claim 1-- |

Signed and Sealed this

Twenty-second Day of December, 1987

*Attest:*

DONALD J. QUIGG

*Attesting Officer*

*Commissioner of Patents and Trademarks*